US011214336B2

(12) United States Patent
DeLauder et al.

(10) Patent No.: US 11,214,336 B2
(45) Date of Patent: Jan. 4, 2022

(54) ROTATIONAL LEASH PLUG SYSTEM FOR SURF BOARDS

(71) Applicants: John DeLauder, San Francisco, CA (US); Stefan Raedler, Amtzell (DE)

(72) Inventors: John DeLauder, San Francisco, CA (US); Stefan Raedler, Amtzell (DE)

(73) Assignee: John Delauder, San Francisco, CA (US)

( * ) Notice: Subject to any disclaimer, the term of this patent is extended or adjusted under 35 U.S.C. 154(b) by 0 days.

(21) Appl. No.: 16/602,793

(22) Filed: Dec. 4, 2019

(65) Prior Publication Data

US 2021/0171160 A1 Jun. 10, 2021

(51) Int. Cl.
*B63B 32/73* (2020.01)
*B63B 32/40* (2020.01)

(52) U.S. Cl.
CPC ..... *B63B 32/73* (2020.02); *B63B 32/40* (2020.02)

(58) Field of Classification Search
CPC ..... B63B 32/70; B63B 32/73; B63B 32/40
USPC ..... 441/75
See application file for complete search history.

(56) References Cited

U.S. PATENT DOCUMENTS

| | | | | |
|---|---|---|---|---|
| 3,802,011 | A * | 4/1974 | Castagnola | B63B 32/70 441/75 |
| 5,199,916 | A * | 4/1993 | Prickett | B63B 32/70 441/75 |
| 5,290,195 | A * | 3/1994 | Prickett | B63B 32/70 441/75 |
| 6,390,872 | B1 * | 5/2002 | Davis | B63B 32/70 441/75 |
| 2008/0260848 | A1 * | 10/2008 | Nagata | A61K 9/0043 424/499 |
| 2012/0227678 | A1 * | 9/2012 | Milani | A01K 1/04 119/712 |
| 2015/0344113 | A1 * | 12/2015 | Friedman | B63B 32/70 224/406 |

* cited by examiner

*Primary Examiner* — Lars A Olson
(74) *Attorney, Agent, or Firm* — Lars A. Olson

(57) ABSTRACT

The invention discloses a rotational leash plug system for surf boards including an outer ring housing, a spherical or cylindrical element, in particular a ball or a cylinder, a stainless steel or brass pin attached to the rolling element and a bottom cap. A safety surf leash is attached to the pin centered in the ball to achieve a safety connection between surfer, in particular attached to the leg of the surfer, and a surfboard. The rotational element is free to rotate in x, y, and z axis inside the outer ring housing and the bottom cap. The spherical element is able to follow the force vector of the leash pulling the pin. The surf plug system can therefore follow the movement of the safety surf leash and or the surfer attached to the leash as soon as there is a pull force applied to the pin inside the surf plug system.

3 Claims, 2 Drawing Sheets

ROTATIONAL LEASH PLUG SYSTEM FOR SURF BOARDS

RELATED EXISTING PATENTS

U.S. Pat. No. 4,044,415 A
U.S. Pat. No. 3,802,011 A
US 20110312233 A1
US 20140141669 A1
U.S. Pat. No. 5,795,205 A
U.S. Pat. No. 8,292,682 B2
U.S. Pat. No. 6,471,560 B2
US 20120227678 A1
U.S. Pat. No. 5,199,916
US 20150344113 A1
US 20080160848
U.S. Pat. No. 6,390,872
U.S. Pat. No. 5,290,195
U.S. Pat. No. 3,802,011

FIELD OF THE INVENTION

The present invention relates to a surf board plug system in particular a system to connect a safety surf leash to a surf board.

BACKGROUND OF THE INVENTION

If a surfer falls off the board, it is beneficial for him to be to be physically connected to the surf board, otherwise the surf board could get lost or be damaged. Therefore surfers connect a safety leash to either one of their legs, their arm or any other part of their body and mount the other end of the leash to the surfboard. In particular the end of the surf leash is usually pulled through a pin inside a surf plug that is fixed inside the surfboard, in particular glued into the surfboard with resin.

DESCRIPTION OF THE RELATED ART

The currently available surf plugs on the market contain a plug, in particular made out of plastic or wood, with a bore in the center in which a stainless steel or brass pin is inserted, in particular glued or pressed in. As the pin is fixed in the plug, it can't rotate or move. Most surf leashes include a rotating system inside the leash, for the purpose for the leash not to get tangled. The connection to the surfboard, in particular to the surf plug, is still stiff and not movable.

The currently available surf plugs on the market aren't providing any flexibility to the surf leash if the surfer falls off the board. The surf leash can easily be tangled or twisted around the board or the surfer.

Technical Problem to be Solved

The object of the present invention is therefore to provide a rotational surf plug to provide more movement and flexibility of the connection between the surfer including the connected surf safety leash and the surf board.

A further problem, the leash plug system can help to prevent, is the so called tombstoning. If a surfer gets extremely deep under the water surface, his leash can be fully outstretched. In this event the front of the board sticks straight upwards while the weight of the surfer pulling down upright the board along the leash. A lot of surfer are not able to fully pull their board up to the surface again and can even drown to this tombstoning effect. With the additional flexibility of the leash plug system, the surfer might be able to pull the board sideways with the leash until the board can completely float up to the surface again.

SUMMARY OF THE INVENTION

The above-identified objects of the present invention are solved by a rotational leash plug system for surf boards. The spherical element of the leash plug system can rotate inside the outer ring housing to make the plug system follow the movement of the attached leash. This creates more flexibility for the surfer while he stands on or when he falls off the board.

DETAILED DESCRIPTION OF THE INVENTION

Figure 1:
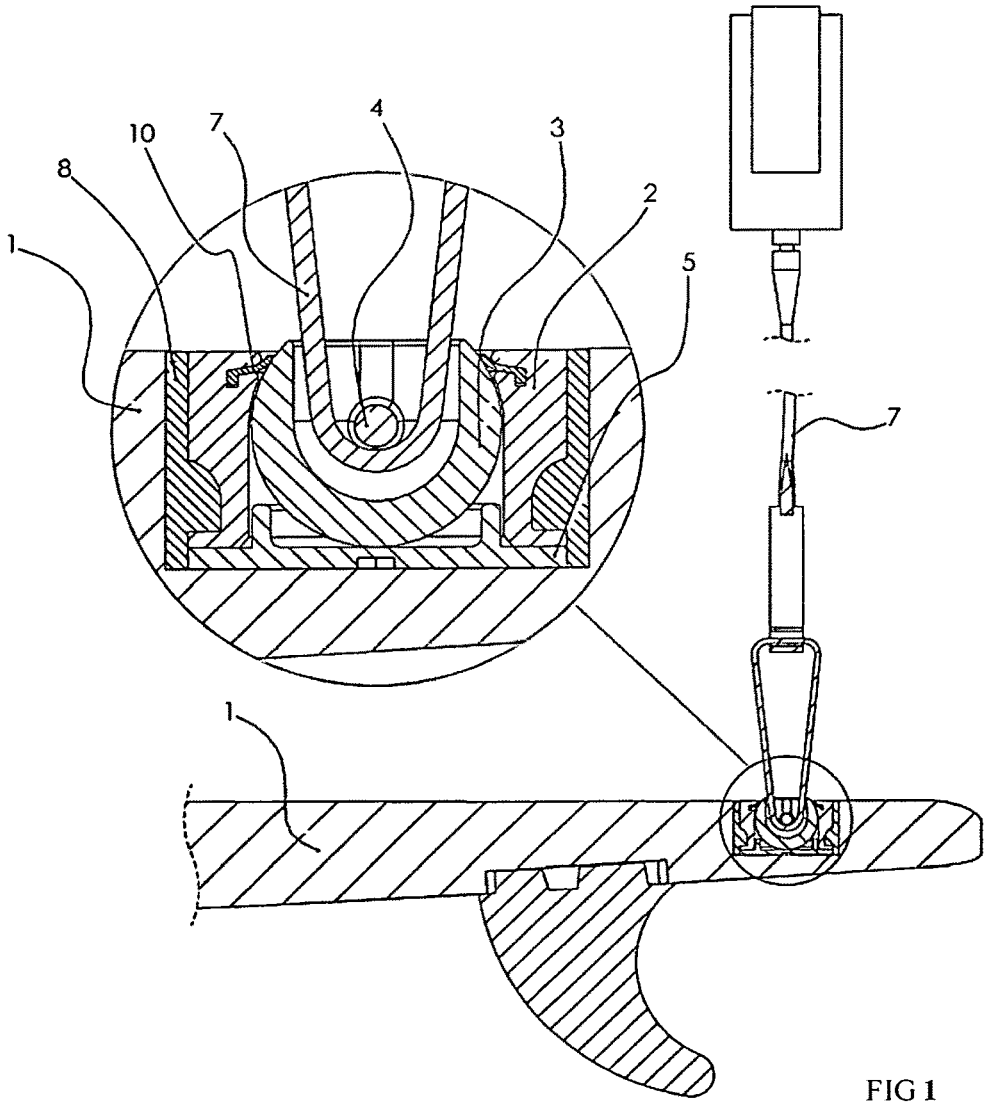
FIG. 1 is a side section view of a surf board with vertical installation of the plug system

A pin 4 is inserted, in particular pressed and or glued into a spherical element, in particular a ball 3 that is inserted into an outer ring housing 2. To prevent the ball from falling out of the outer ring housing 2 during the insertion into the surf board, and to prevent debris, glue or resin to enter the leash plug system 6 from the bottom, a bottom cap 5 is inserted into the outer ring housing 2, in particular pressed and or glued in. The spherical element 3 is now able to roll on the raceway surface of the outer ring housing 2 and on the raceway surface of the bottom cap 5. A hole needs to be drilled into the surfboard 1 and in particular needs be filled with resin 8. The leash plug system 6 is pushed into the resin 8 that creates a material bond between outer ring housing 2, bottom cap 5, and the surfboard 1. One end of the cord of the safety leash 7 is pulled through the spherical element 3 underneath the pin 4 and be connected back to the surf leash 7. The pin 4 prevents the leash 7 from being pulled out of the spherical element 3 which creates a connection between surf leash 7, the pin 4 and the spherical element 3. As the spherical element 3 is able to roll on the raceway of the outer ring housing 2 and the raceway of the bottom cap 5 the spherical element 3 can rotate freely and will be directed into the direction of the surf leash 7.

Figure 2:
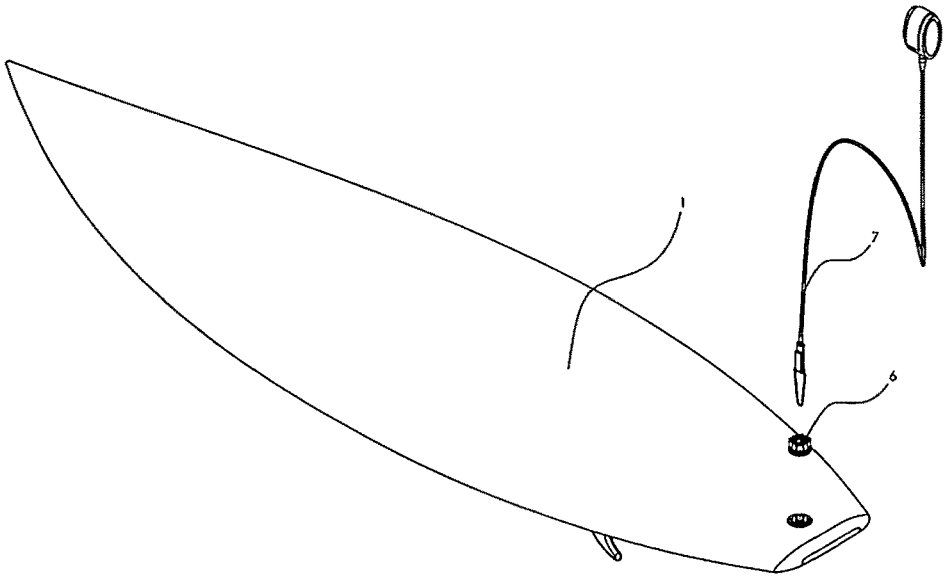
FIG. 2 is a perspective explosion view of a surf board with vertical installation of the plug system
Figure 3:
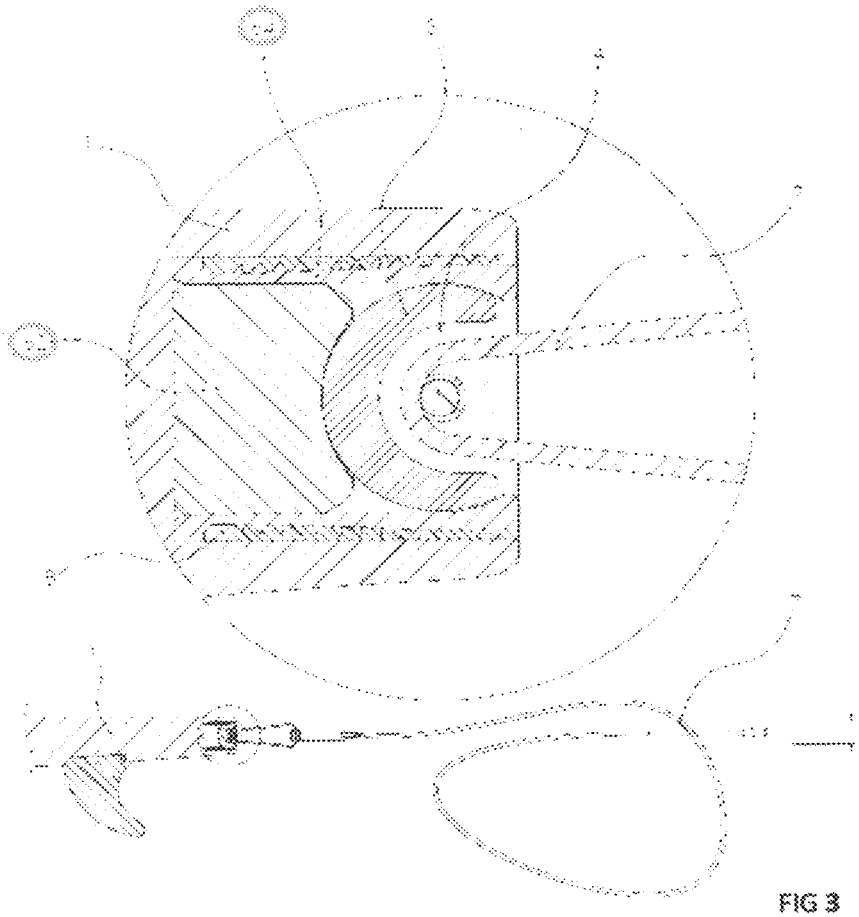
FIG. 3 is a side section view of a surf board with horizontal installation of the plug system
Figure 4:
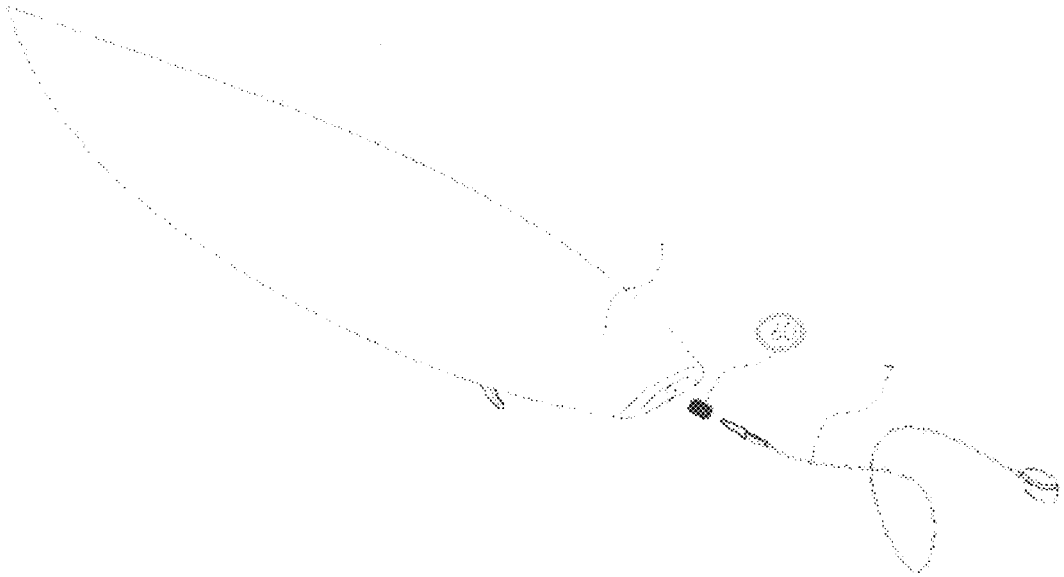
FIG. 4 is a perspective explosion view of the surf board with horizontal installation of the plug system

This description is valid for both the vertical installation of the surf plug system FIG. 1 and FIG. 2, as well as the horizontal installation of the surf plug system FIG. 3 and FIG. 4. It is also possible to additionally ad a seal 10 between spherical element 3 and outer ring housing 2 to prevent sand or debris from getting in the gap between the spherical element 3 and the outer ring housing 2 raceway.

FIG. 2 is a perspective view of surfboard 1 with the surf leash system assembly 6 ready to be inserted into aperture FIG. 3 is a perspective view of an alternate embodiment where the alternate surf leash system assembly 60 is installed at the rear edge of the surfboard 1 and held in place by epoxy resin 8. A plug 62 cradles the bottom of ball 3 and an outer sleeve 64 cradles the sides of ball 3. The outer sleeve 64 captures the ball 3 and allows it to rotate freely without being impeded by sand or other debris. Surfboard leash 7 is identical in structure and operation as the first embodiment of the invention.

FIG. 4 is a perspective view showing the alternate embodiment 60 about to be installed into the aperture of surf board 1.

REFERENCE LIST pin 4
spherical element, ball 3
outer ring housing 2
bottom cap 5
surf board 1
leash plug system 6
resin 8
surf leash attachment cable 7
seal 10
leash plug system alternate embodiment 60
plug in alt. embodiment 62
outer sleeve in alt. embodiment 64

What is claimed is:

1. A rotational leash assembly system for surfboards comprising:

a spherical element;

an outer ring housing;

a bottom cap;

a metal shaft member;

said spherical member having a cup shaped recess;

said spherical member rotatably enclosed within said outer ring housing and said bottom cap;

said outer ring member and bottom cap capable of being glued into a recess formed within a standard surfboard thereby fixedly attaching said rotational leash assembly to said surfboard;

said metal shaft member horizontally embedded into said spherical member in such a way that said metal shaft member is exposed within said cup shaped recess and said metal shaft member capable of slidably retaining a surf leash cable with said metal shaft member with said metal shaft member as the surf leash cable connection being located within the geometry of the spherical element.

2. A rotational leash assembly system for surfboards as claimed in claim 1 wherein said outer ring housing comprises ring portion and a separate top cover portion;

said top cover portion having an aperture allowing said surf leash cable to exit said ring housing and said top cover portion being glued or co-molded onto said ring portion.

3. A rotational leash assembly system for surfboards as claimed in claim 1 wherein said assembly can be inserted into a hole type aperture either on the top surface of a surfboard or on the rear edge of a surfboard.

* * * * *